US005860299A

United States Patent [19]

Eum et al.

[11] Patent Number: 5,860,299

[45] Date of Patent: Jan. 19, 1999

[54] POWER SYSTEM OF CLOTHES WASHING MACHINE

[75] Inventors: Jae-Yong Eum; Hwan-Young Choi, both of Kyungki-Do, Rep. of Korea

[73] Assignee: Samsung Electronics Co., Ltd., Suwon, Rep. of Korea

[21] Appl. No.: 966,996

[22] Filed: Nov. 10, 1997

[30] Foreign Application Priority Data

Feb. 18, 1997 [KR] Rep. of Korea ..... 1997-4857

[51] Int. Cl.[6] ..... D06F 37/40

[52] U.S. Cl. ..... 68/23.7; 68/133; 74/33

[58] Field of Search ..... 68/23.6, 23.7, 68/28.3, 13.3; 8/159; 74/33, 32

[56] References Cited

U.S. PATENT DOCUMENTS

| | | | |
|---|---|---|---|
| 4,395,890 | 8/1983 | Goodlaxson | 68/133 |
| 5,379,616 | 1/1995 | Bae | 68/23.7 |
| 5,491,859 | 2/1996 | Richardson | 68/23.3 |
| 5,522,242 | 6/1996 | Hauser | 68/23.7 |
| 5,638,719 | 6/1997 | Crain et al. | 68/23.7 |
| 5,655,389 | 8/1997 | Johnson et al. | 68/23.7 |
| 5,720,065 | 2/1998 | Myers et al. | 68/23.7 |
| 5,737,944 | 4/1998 | Nishimura et al. | 68/23.7 |

FOREIGN PATENT DOCUMENTS

| | | | |
|---|---|---|---|
| 60-16391 | 8/1985 | Japan | 68/23.7 |
| 63-28638 | 6/1988 | Japan | 68/23.7 |

*Primary Examiner*—Frankie L. Stinson

*Attorney, Agent, or Firm*—Burns, Doane, Swecker & Mathis, L.L.P.

[57] ABSTRACT

A clothes washing machine includes a water tub, a spin basket, and a clothes agitator. A vertical dehydrating shaft is fixed to the spin basket, and a laundering shaft extends coaxially within the dehydrating shaft. Upper and lower ends of the laundering shaft are connected to the agitator and a motor respectively, whereby rotation of the motor is always transmitted to the agitator. In order to selectively connect the dehydrating shaft to the laundering shaft (e.g., during a spin-drying operation), a connecting gear is mounted on the dehydrating shaft for rotation therewith and for vertical movement relative thereto. A power-driven actuator is provided for selectively moving the connecting gear up or down. When the connecting gear moves down, lower teeth thereon become operably connected to the motor so that the dehydrating shaft and laundering shaft rotate together. During a washing or rinsing operation, the connecting gear is moved up, whereby upper teeth thereon become connected to a fixed element, whereby the dehydrating shaft is fixed against rotation.

6 Claims, 5 Drawing Sheets

POWER SYSTEM OF CLOTHES WASHING MACHINE

BACKGROUND OF THE INVENTION

1. Field of the Invention

The present invention relates to a power system of a clothes washing machine.

2. Description of the Related Art

Generally, a washing machine includes a main body defining an outer configuration thereof, a water tub installed within the body, and a rotating drum (spin basket) and blade mounted within the water tub. A power system for driving the rotating drum and blade is mounted under the water tub.

The power system conventionally comprises a motor, a power transmission system, and a belt for connecting the motor to the power transmission system. This will be described hereinbelow with reference to FIG. 5.

As shown in the drawing, a conventional power transmission system 10 has a hollow dehydrating or spin drying shaft 11 and a laundering shaft 12 inserted into the hollow portion of the hollow dehydrating shaft 11. The laundering shaft 12 is divided into upper and lower portions, with a planetary gear unit 13 being disposed therebetween. The planetary gear unit 13 changes a rotating speed of the power transmission system 10. A brake band 14 and a brake lever 15 are disposed beside the dehydrating shaft 11 to brake the rotation of the dehydrating shaft 11. A one-way bearing 16 cooperates with the brake band 14 for suppressing rotation of a rotating drum 20 and permitting the dehydrating shaft 11 to rotate in only one direction. The bearing is mounted on an outer circumference of the dehydrating shaft 11. In addition, a clutch spring 17 and a clutch lever 18 for transmitting/interrupting power from the motor to both the dehydrating shaft 11 and the laundering shaft 12 are mounted under the one-way bearing 16. A pulley 19 on which a belt (not shown) is engaged is mounted on a lower end of the laundering shaft 12.

In this conventional power transmission system 10, torque of the motor is selectively transmitted to a rotating agitator blade 21 or both the blade and the rotating drum 20 through the clutch spring 17, thereby performing the washing and dehydrating operations. To achieve this, it is necessary that the clutch spring 17 has a high degree of tensile strength to enable the transmission or interruption of torque from the motor to the dehydrating shaft 11 and the laundering shaft 12, both of which are rotated at a high speed. However, the manufacturing process for such a spring having high tensile strength is complicated, and, as a result, manufacturing costs are increased.

In addition, the brake band 14 for preventing the rotating drum 20 from idling during the washing operation is, when it brakes the rotating drum 20 in one direction, subjected to a relatively high force generated when the rotating drum 20 is being urged to rotate by water currents being generated. As a result, the above described one-way bearing 16 must be used, making the structure complicated and increasing manufacturing costs.

Finally, an unpleasant noise is generated during the braking operation of the brake band.

As described above, the conventional power system of a washing machine is complicated with regard to the arrangement of parts for performing the washing, dehydrating and braking operations, making it difficult to manufacture the same and increasing manufacturing costs. In addition, because of the large number of parts needed for this complicated arrangement, much space is required which, in turn, acts to increase the overall size of the washer.

SUMMARY OF THE INVENTION

Therefore, the present invention is made in an effort to solve the above described problems.

It is an object of the present invention to provide a washing machine having a power system which is simple in its structure, thereby reducing the overall size, especially the height thereof.

To achieve the above objects, the present invention relates to a clothes washing machine comprising a water tub, a spin basket mounted in the water tub for rotation relative thereto about a vertical axis, a motor disposed beneath the water tub, and a drive transmitting mechanism for transmitting rotation between the agitator and spin basket. That mechanism comprises a hollow vertical dehydrating shaft having an upper end connected to the spin basket for rotation therewith, and a laundering shaft extending within the dehydrating shaft. An upper end of the laundering shaft is operably connected to the agitator for rotation therewith. A lower end of the laundering shaft is operably connected to the motor to be driven thereby about the axis. A fixing plate is fixed to the spin basket, and a coupling gear is operably connected to the motor to be driven thereby. A connecting gear is mounted on the dehydrating shaft for common rotation therewith and for vertical movement relative thereto between upper and lower positions. The connecting gear includes first engagement means connectable with the fixing plate when the connecting gear is in the upper position, for preventing rotation of the dehydrating shaft and the spin basket. The connecting gear includes second engagement means connectable with a coupling gear when the connecting gear is in the lower position, to interconnect the connecting gear and the coupling gear for rotation and thereby enable the motor to rotate the dehydrating shaft and the laundering shaft together. An elevating mechanism is provided for raising and lowering the connecting gear between the upper and lower positions. The elevating mechanism preferably includes an elevating member mounted on the dehydrating shaft for rotation relative thereto and for vertical movement relative thereto. The connecting gear is vertically movable with the elevating member. Also provided is a guide ramp which is inclined relative to a horizontal plane, and a projection slidably engaging the guide ramp. Either the guide ramp or the projection is stationary, and the other is fixed to the elevating member for causing the elevating member to move vertically in response to rotation of the elevating member. A power driven actuator is connected to the elevating member for rotating the elevating member in selected directions for causing the elevating member and the connecting gear to move upwardly or downwardly.

Preferably, the projection is carried by the elevating member, and the inclined ramp is formed in a portion of the fixing plate which extends coaxially relative to the axis.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF A PREFERRED EMBODIMENT OF THE INVENTION

Reference will now be made in detail to the present preferred embodiments of the invention, examples of which are illustrated in the accompanying drawings. Wherever possible, the same reference numbers will be used throughout the drawings to refer to the same or like parts.

Figure 1:
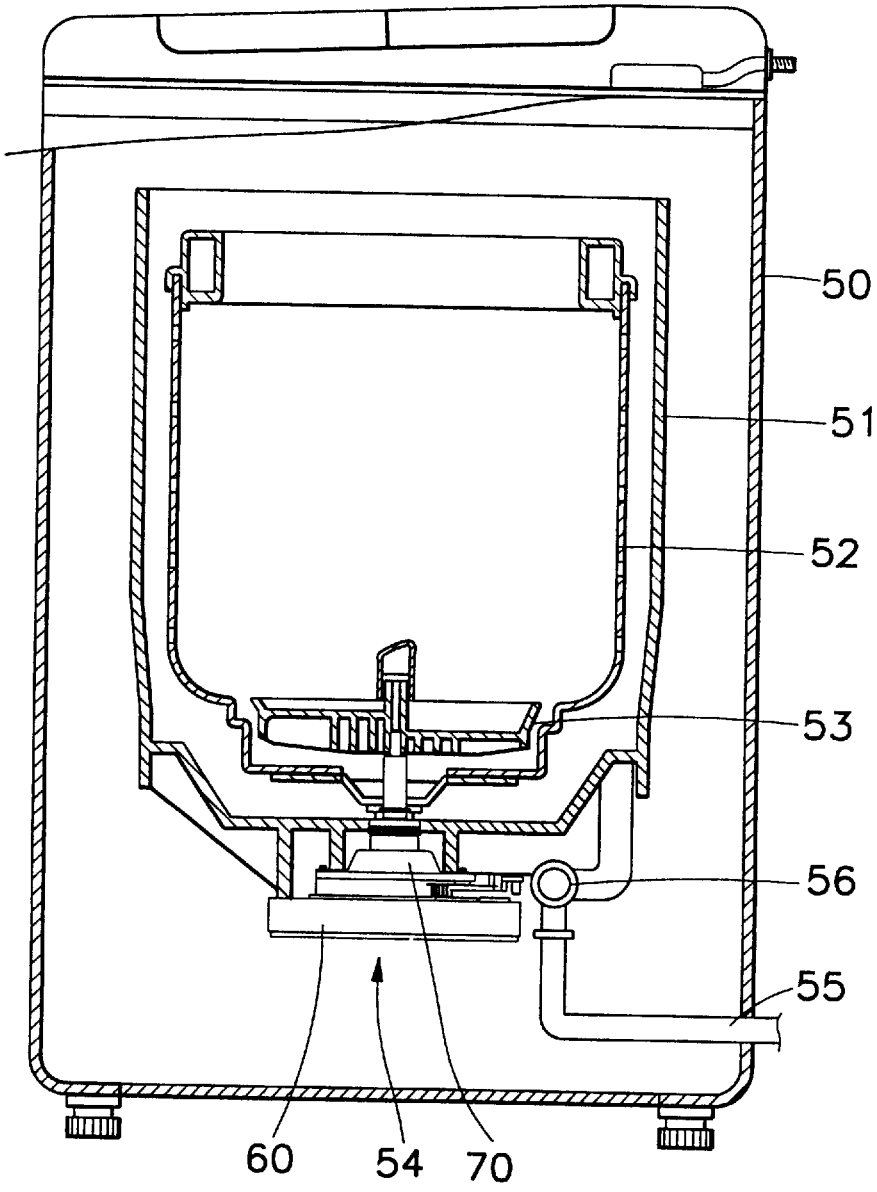
FIG. 1 is a side sectional view illustrating a washing machine where a power system according to the present invention is installed.

Referring first to FIG. 1, the inventive washing machine of the present invention comprises a main body 50 defining an outer configuration thereof and a water tub 51 installed inside the main body 50 which holds water. A rotating drum or spin basket 52, inside of which laundry is washed, is provided inside the water tub 51. Installed above a bottom surface of the spin basket 52 is a rotating agitator blade assembly 53 which rotates (oscillates) in forward and reverse directions so as to generate water currents.

A power system 54, for driving the rotating blade assembly 53 and the spin basket 52, is installed under the water tub 51. The power system 54 comprises a reversible motor 60 and a power transmission system 70, which transmits a rotating force of the reversible motor 60 to the rotating blade assembly 53 or to both the assembly 53 and the spin basket 52.

The motor 60 is a brushless DC motor which is variable in its rotating speeds and which enables the spin basket 52 and the rotating blade assembly 53 to abruptly stop.

The power transmission system 70 is structured such that torque of the motor 60 can be transmitted to only the rotating blade assembly 53 during a wash cycle or, during dehydration, to both the rotating blade assembly 53 and the spin basket 52.

In addition, a drain hose 55 is mounted on the right side (in the drawing) of the water tub 51, the drain hose 55 draining the water in the water tub 51 to the outside of the main body 50. A drain valve 56 for opening/closing the drain hose 55 is mounted on the drain hose 55. A drain motor (not shown), which controls the operation of the drain valve 56 and the power transmission system 70, is mounted between the drain valve 56 and the power transmission system 70.

Figure 2:
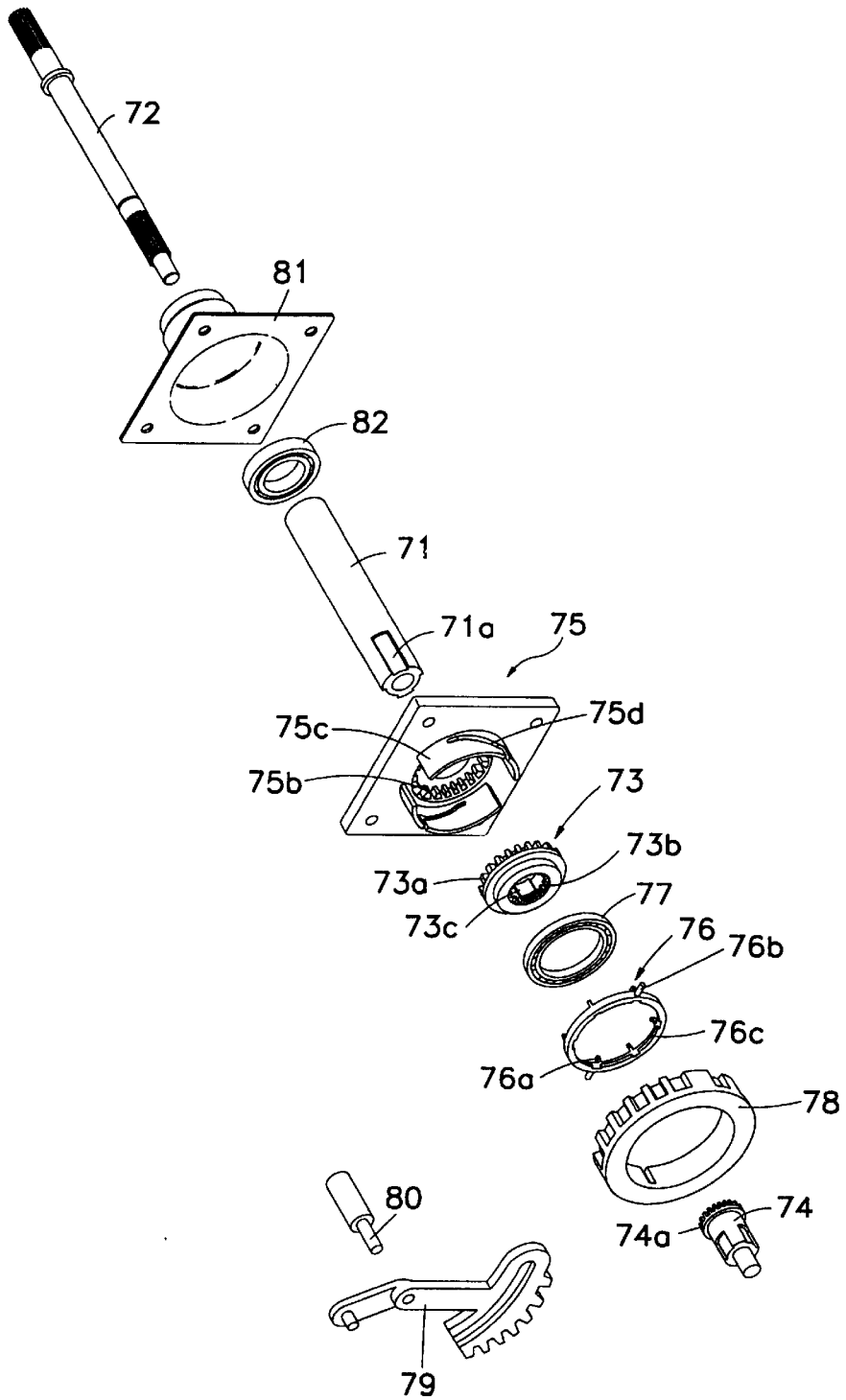
FIG. 2 is an exploded perspective view of a power system according to a preferred embodiment of the present invention.
Figure 3:
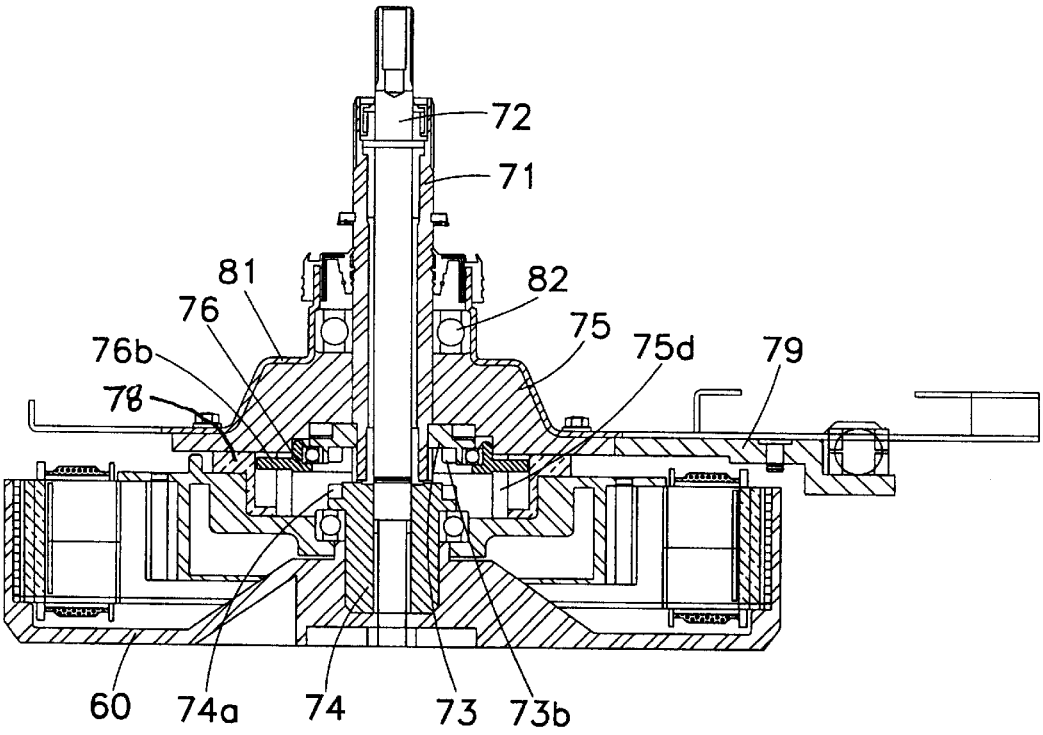
FIG. 3 is a sectional view showing a power system according to a preferred embodiment of the present invention.

The power transmission system 70 will be described hereinafter more in detail with reference to FIGS. 2 and 3.

As shown in the drawings, the power transmission system 70 comprises a hollow dehydrating shaft 71 coupled at its upper portion to the spin basket 52 and passing through a bottom surface of the water tub 51. A laundering shaft 72 is inserted into the dehydrating shaft 71, an upper end of which is coupled to the rotating blade assembly 53 and a lower end of which is coupled to the reversible motor 90. A ring-shaped connecting gear 73 is mounted on the dehydrating shaft 71 for vertical movement relative thereto so as to selectively connect the dehydrating shaft 71 to the laundering shaft 72 for common rotation.

More in detail, the dehydrating shaft 71 penetrates the water tub 51 such that an upper end of the shaft 71 is integrally coupled to the spin basket 52. The upper end of the laundering shaft 72 is integrally coupled to the rotating blade assembly 53, and the lower end thereof is snugly inserted into the motor 60.

A coupling gear 74 which is designed to integrally rotate with the reversible motor 60 is mounted on a lower end of the laundering shaft 72 to rotate integrally therewith. Coupled on an inner bottom surface of the water tub 51 is a fixing plate 75. The connecting gear 73 is designed to mesh with the fixing plate 75 when the gear 73 is raised and to mesh with the coupling gear 74 when the gear 73 is lowered. That is, the coupling gear 74 is provided with outer teeth 74*a*, formed on its upper outer circumference, which mesh with the connecting gear 73 when the connecting gear 73 descends. The laundering shaft 72 is coupled to the coupling gear 74 by splines for common rotation therewith.

Figure 4:
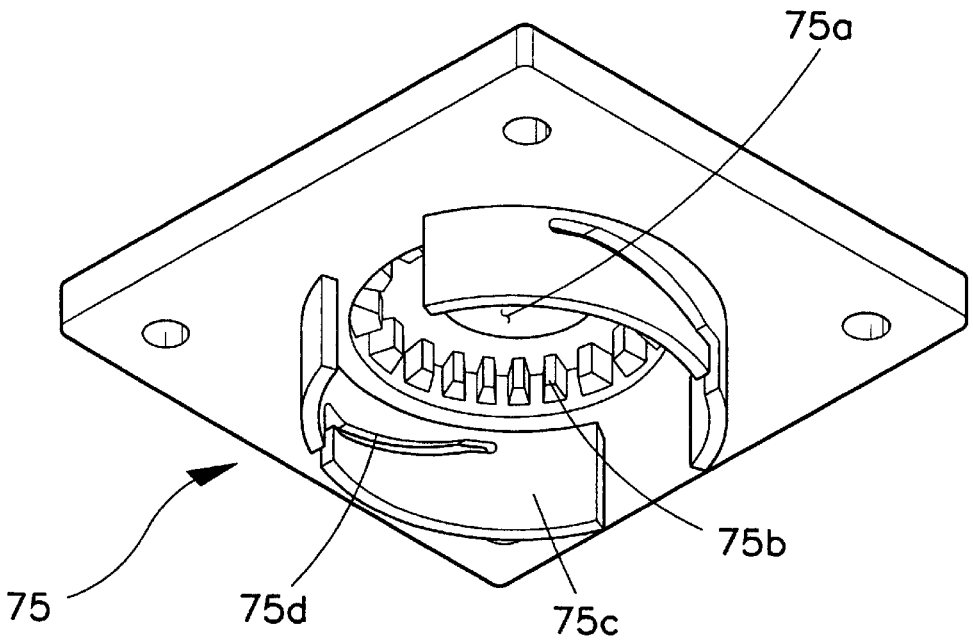
FIG. 4 is a perspective view showing a fixing plate depicted in FIG. 3.
Figure 5:
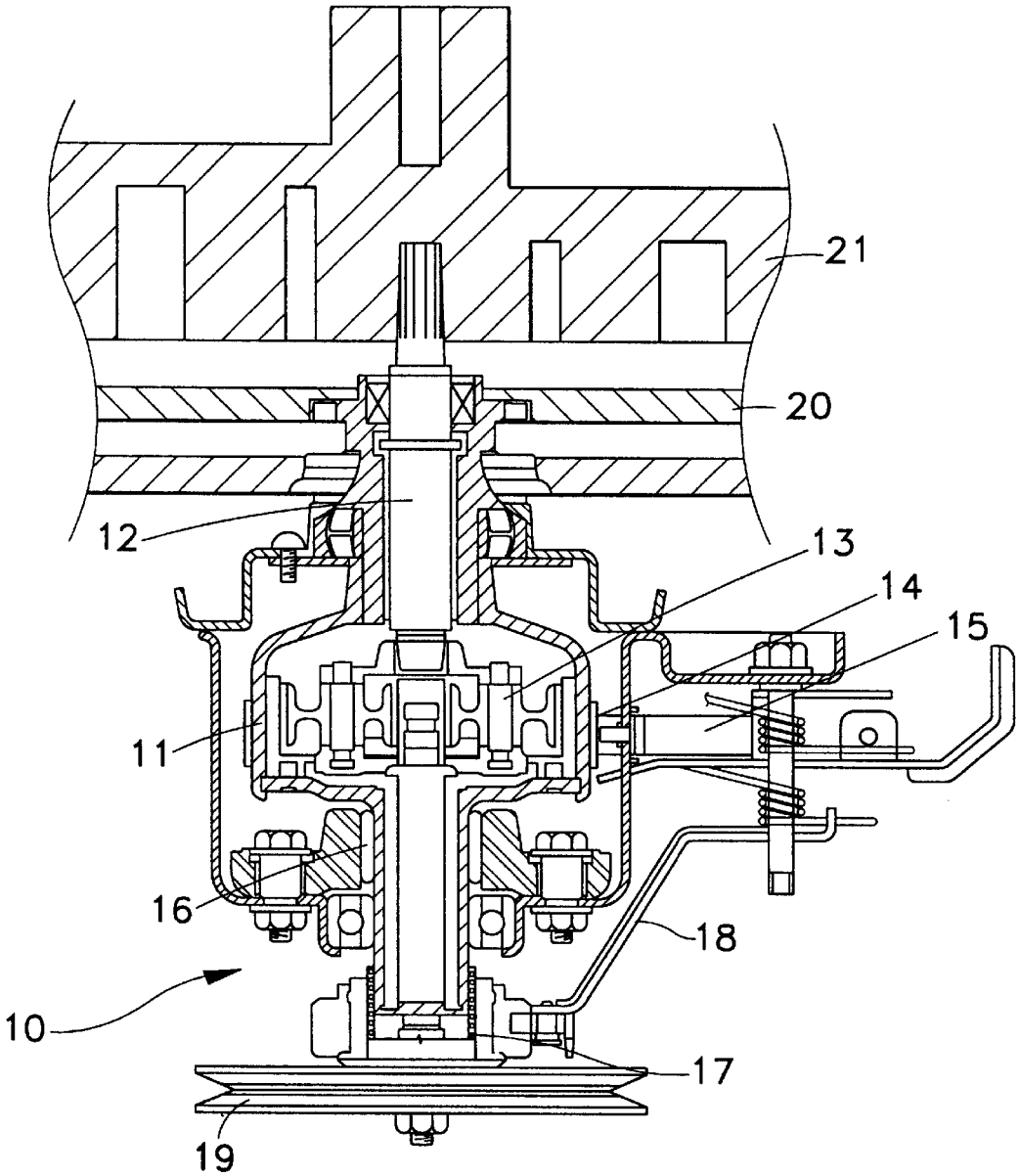
FIG. 5 (Prior Art)
FIG. 5 is a sectional view of a conventional power transmission system of a washing machine.

In addition, the fixing plate 75 is provided with an opening 75*a* with teeth 75*b* as shown in FIG. 4. The connecting gear 73 is provided at its top surface with outer teeth 73*a* capable of meshing with the teeth 75*b* of the fixing plate 75 and at its bottom surface with inner teeth 73*b* meshing with the teeth 74*a* of the coupling gear 74. Accordingly, when the connecting gear 73 is raised, it is coupled for rotation to the fixing plate 75 so as to suppress rotation of the dehydrating shaft 71 and, when lowered, the gear 73 is coupled to coupling gear 74 so as to cause the dehydrating shaft 71 to rotate together with the laundering shaft 72.

Vertically extending guide grooves 71*a* are formed on an lower outer side of the dehydrating shaft 71 and are spaced circumferentially from each other at equal distances. Guide projections 73*c* are formed on an inner surface of the connecting gear 73 and are inserted into respective guide grooves 71*a*. Therefore, the connecting gear 73 rotates together with the dehydrating shaft 71 while able to slide therealong.

In addition, there is provided an elevating ring 76 which can ascend and descend together with the connecting gear 73, but can rotate relative thereto. The elevating ring 76 is mounted on the connecting gear 73 by means of a bearing 77 disposed within an inner circumference of the ring 76. The elevating ring 76 is provided at its lower inner surface with a plurality of projections 76*c* for supporting the bearing 77, and at its upper surface with a plurality of stoppers 76*a* for supporting the connecting gear 73, thereby fixing the bearing 77 within the elevating ring 76.

A pair of generally semi-cylindrical elevating guide members 75*c* extend downwardly from the fixing plate 75 and are disposed around the elevating ring 76 to guide the vertical movements of the elevating ring 76. The cylindrical elevating guide members 75*c* extend downwardly from the periphery of the opening 75*a*. An inclined elevating guide slit or ramp 75*d* which has an open lower end is formed in each elevating guide member 75*c*. Projections 76*b* which are inserted into respective inclined elevating guide slits 75*d* are formed on the elevating ring 76.

In addition, there is provided a rotating member which rotates the elevating ring 76 to raise the connecting gear 73. The rotating member comprises a rotating gear 78 disposed around the elevating guide members 75*c* and an actuator in the form of a rotating bar 79. A free end of each projection 76*b* penetrating an elevating guide slit 75*d* is engaged with an inner surface of the rotating gear 78. The rotating gear 78 is provided with outer teeth, and the rotating bar is provided at one of its ends with teeth engaged with the outer teeth of the rotating gear 78. The rotating bar is mounted to rotate about an intermediate shaft 80. The other end of the rotating bar is connected to a drain-opening motor through a link (not shown).

A reinforcing plate 81 is mounted on a portion of the fixing plate 75 where the dehydrating shaft 71 is inserted, and a bearing 82 is disposed between the dehydrating shaft 71 and the reinforcing plate 81.

The operation of the above described power transmission system 70 of the washing machine according to the present invention will be described hereinafter.

Describing first a washing operation, the connecting gear 73 is in a raised state in engagement with the fixing plate 75 and the dehydrating shaft 71. In this state, the motor oscillates the laundering shaft 72 in forward and reverse directions at a suitable speed. With the oscillation of the laundering shaft 72, the agitator blade assembly 53 coupled to the laundering shaft 72 is also oscillated to generate a water current, thereby performing the laundering operation.

Now, describing the dehydrating operation, the drain motor (not shown) is operated to open the drain valve, and also to rotate the outer end of the rotating bar 79 about the shaft 80. As a result, the rotating gear 78 meshing with the inner end of the rotating bar 79 is rotated, thereby rotating the projections 76*b*. At this point, the projections 76*b* descend along the inclined surfaces of the elevating guide slits 75*d* such that the connecting gear 73 resting on the elevating ring 76 descends and meshes with the coupling gear 74. That is, as the connecting gear 73 descends along the elevating guide slit 75*d*, the inner teeth 73*b* formed on the connecting gear 73 mesh with the teeth 74*a* of the coupling gear 74, whereby the laundering shaft 72 becomes connected for rotation with the dehydrating shaft 71. In this state, by the operation of the motor 60, the dehydrating (spin drying) operation is performed. That is, the rotating force of the motor 60 is transmitted to the laundering shaft 72 and thus to the agitator 53, and further to the spin basket 52 through the dehydrating shaft 71. By this operation, the rotating blade assembly 53 and the spin basket 52 rotate at a high speed such that the water retained in the laundry is squeezed out by the resulting centrifugal force and drained through the drain hose 55.

In the power transmission system 70 as described above, since idling (rotation) of the spin basket 52 during the laundering operation can be suppressed by the gear 73, frictional noise can be reduced.

In addition, as the structure for transmitting rotating force of the motor and for preventing idling of the rotating drum is composed of three simple parts, manufacturing costs can be reduced.

Furthermore, since the number of parts of the system can be decreased, the size of the washing machine can be reduced.

While the invention has been described in connection with what is presently considered to be a most practical and preferred embodiment, it is to be understood that the invention is not limited to the disclosed embodiment, but, on the contrary, it is intended to cover various modifications and equivalent arrangements included within the spirit and scope of the appended claims. For example, the guide slits 75*b* could be formed in the elevating ring 76, and the projections 76*b* formed on the guide members 75*c*.

What is claimed is:

1. A clothes washing machine comprising:

a water tub;

a spin basket mounted in the water tub for rotation relative thereto about a vertical axis;

an agitator mounted in the spin basket for rotation about the axis;

a motor disposed beneath the water tub; and a drive transmitting mechanism for transmitting rotation between the agitator and spin basket comprising:

a hollow vertical dehydrating shaft having an upper end connected to the spin basket for rotation therewith;

a laundering shaft extending within the dehydrating shaft, an upper end of the laundering shaft operably connected to the agitator for rotation therewith, a lower end of the laundering shaft operably connected to the motor to be driven thereby about the axis;

a stationary fixing element;

a coupling gear operably connected to the motor to be driven thereby;

a connecting gear mounted on the dehydrating shaft for common rotation therewith and for vertical movement relative thereto between upper and lower positions, the connecting gear including first engagement means connectable with the fixing when the connecting gear is in the upper position, for preventing rotation of the dehydrating shaft and the spin basket, the connecting gear including second engagement means connectable with the coupling gear when the connecting gear is in the lower position to interconnect the connecting gear and the coupling gear for rotation and thereby enable the motor to rotate the dehydrating shaft and the laundering shaft together; and an elevating mechanism for raising and lowering the connecting gear between the upper and lower positions, wherein the elevating mechanism includes an elevating member mounted on the dehydrating shaft for rotation relative thereto and for vertical movement relative thereto; the connecting gear being vertically movable with the elevating member; a guide ramp inclined relative to a horizontal plane, and a projection slidably engaging the guide ramp; one of the guide ramp and projection being stationary, and the other of the guide ramp and projection being fixed to the elevating member, for causing the elevating member to move vertically in response to rotation of the elevating member and a power-driven actuator connected to the elevating member for rotating the elevating member in selected directions for causing the elevating member and the connecting gear to move upwardly or downwardly.

2. The washing machine according to claim 1 wherein the projection is carried by the elevating member.

3. The washing machine according to claim 2 wherein the guide ramp is formed in a portion of the fixing plate extending coaxially relative to the axis.

4. The washing machine according to claim 3 wherein there is a plurality of the guide ramps and a plurality of the projections engaging respective ones of the guide ramps.

5. The washing machine according to claim 1 wherein each of the first and second engagement means comprise teeth.

6. The washing machine according to claim 1 wherein the fixing element comprises a plate fixed to the water tub.

* * * * *